US005844481A

United States Patent [19]

Quintus et al.

[11] Patent Number: 5,844,481

[45] Date of Patent: Dec. 1, 1998

[54] INTRUSION DETECTOR FOR SECURITY SYSTEMS

[76] Inventors: John J. Quintus, 245 Fischer Ave., Bldg. A4, Costa Mesa, Calif. 92626; Louis J. Finkle, 3300 E. 59th St., Long Beach, Calif. 90805

[21] Appl. No.: 814,556

[22] Filed: Mar. 11, 1997

[51] Int. Cl.[6] ..... G08B 13/08

[52] U.S. Cl. ..... 340/545; 340/507; 340/512; 340/547

[58] Field of Search ..... 340/547, 545, 340/507, 512, 541

[56] References Cited

U.S. PATENT DOCUMENTS

| | | | |
|---|---|---|---|
| 3,792,493 | 2/1974 | Hughes | 346/20 |
| 4,258,358 | 3/1981 | Lee et al. | 340/547 |
| 4,866,426 | 9/1989 | Evans et al. | 340/568 |
| 5,534,849 | 7/1996 | McDonald et al. | 340/547 |

*Primary Examiner*—Glen Swann

*Attorney, Agent, or Firm*—Edgar W. Averill, Jr.

[57] ABSTRACT

An intrusion detector for security systems includes a stationary host unit and a transponder unit secured to a movable door, window or the like. The host unit is secured to a stationary frame in alignment with the transponder unit. A pair of electromagnetic coupling elements are supported upon the host unit and are aligned with a corresponding mirror image pair of electromagnetic coupling units supported on the transponder unit. The host unit provides a burst of power signal which is magnetically coupled to the transponder unit and rectified therein to provide operative power for the transponder unit. The host unit further provides a data signal magnetically coupled to the transponder unit which communicates a random number to the transponder unit. The transponder unit calculates a pseudo-random number using a predetermined algorithm and communicates the random number back to the host unit. The host unit performs an identical calculation upon the random number to provide a reference pseudo-random number. The host unit then compares the received pseudo-random number to the reference calculated pseudo-random number to verify the continued presence of the transponder unit.

17 Claims, 4 Drawing Sheets

INTRUSION DETECTOR FOR SECURITY SYSTEMS

SPECIFICATION

1. Field of the Invention

This invention relates generally to security systems and particularly to intrusion detectors used therein.

2. Background of the Invention

Security systems used for the protection of industrial and commercial facilities as well as homes and storage facilities or other building and dwellings often rely upon devices known generally as intrusion detectors. Basically, such intrusion detectors function to sense and alert the security system and its operators to the opening of an entrance door, window or the like. While devices using various technologies such as optical detectors and electrical contact apparatus are known in the art, the most pervasive and common type of intrusion detectors are generally magnetically operated.

Magnetic intrusion detectors typically utilize pairs of magnets or combinations of items fabricated of magnetic or ferromagnetic material positioned in alignment on the movable door, window, etc. and its proximate stationary frame. In the typical alignment of the paired elements, magnetic coupling occurs between the elements in the stationary frame and the elements within the movable door, window, etc. When the protected door, window or the like is closed, this alignment produces magnetic coupling and the detector senses the proper closure. When the door, window or the like is opened, the magnetic coupling between element pairs is disturbed. Electronic sensors or magnetically actuated switches or other similar apparatus which are operatively coupled to the stationary magnetic element in the frame respond to this change in magnetic characteristic and produce output signals indicating an intrusion.

Such basic magnetic intrusion detectors have several advantages such as simple fabrication, ease of installation, low cost and reliability. Unfortunately, they are also relatively easy to defeat as intruders employ shunt magnets or other apparatus to facilitate opening the door or window without disturbing the magnetic characteristics of the stationary magnetic elements. To exacerbate matters, many security systems are completely defeated if the intrusion detector is overcome and fails to detect an intruder's entrance. In attempting to provide magnetic intrusion detectors which are more difficult to overcome and defeat, practitioners in the art have provided variations of the basic magnetic intrusion detectors and more complex apparatus. For example, U.S. Pat. No. 5,534,849 issued to McDonald, et al. sets forth a TIME MULTIPLEXED FALSE ALARM RESISTANT MAGNETICALLY ACTUATED SECURITY SYSTEM having a reduced sensitivity to false alarms and reduced power consumption as well as resistance to physical and magnetic tampering. The system includes a signal processing circuit controlled by a microprocessor which selectively enables magnetic sensors and compares the corresponding sensor outputs to an automatically calibrated level and predetermined timing characteristics.

U.S. Pat. No. 4,866,426 issued to Evans, et al. sets forth a MAGNETIC AMPLIFIER HOUSING AND DETECTOR FOR AN IMPROVED TAMPER ALARM SYSTEM in which a magnetic amplifier housing is used as a base, dowel and shunt to magnetizable material to concentrate the magnetic field of a ring magnetic through a Hall Effect transistor to provide an improved detector device with increased gain. The detector device causes polarity reversal when tampered with. The housing ensures positive mechanical alignment of the transistor and mechanical components and protection of the transistor from mechanical damage.

U.S. Pat. No. 4,258,358 issued to Lee, et al. sets forth a DOOR OPENING SENSING AND ALARM PRODUCING DEVICE having a housing supporting a keyboard and loud speaker together with electronic components within the housing. The housing is mounted on a door adjacent a magnet mounted on the door frame. The device includes an audio alarm circuit including a loud speaker and controlling circuit for generating an audio alarm. Signal generating circuitry including door motion sensing logic detect door opening and generate an alarm signal. The device further includes a programmable alarm inhibiting circuit including a keyboard and decoding logic.

U.S. Pat. No. 3,792,493 issued to Hughes sets forth a DOOR ACTUATED TIME RECORDER within a security system for detecting the opening or closing of the door of an enclosed area. The door includes a fin having a pair of magnets which enter a slot in the enclosure when the door is closed and which are removed therefrom when the door is open. A detector and associated circuitry in the enclosure sends the presence or absence of the magnets and provide corresponding signals to a storage register each time the door is opened or closed. The storage register is coupled to an illuminated display by decoder drivers causing the time to be displayed in Arabic numerals.

While the foregoing described illustrative prior art devices have provided improvement in the art and, in some instances, enjoyed commercial success, there remains nonetheless a continuing need in the art for evermore improved magnetic intrusion detectors for security systems. There further remains a continuing need in the art for intrusion detectors for security systems which are more resistant to efforts on the part of intruders directed toward defeating the intrusion detector of the security system.

SUMMARY OF THE INVENTION

Accordingly, it is a general object of the present invention to provide an improved security system. It is a more particular object of the present invention to provide an improved magnetic intrusion detector for security systems. It is a still further object of the present invention to provide an improved magnetic intrusion detector which is resistant to electronic, magnetic, and physical tampering efforts on the part of the would-be-intruders.

In accordance with the present invention, there is provided an intrusion detector comprising: a host unit having first means for magnetically communicating a signal, second means for receiving a magnetically communicated signal and first circuit means; and a transponder unit having third means for magnetically communicating a signal, fourth means for receiving a magnetically communicated signal, second circuit means, and rectifier means coupled to the fourth means, the host unit and the transponder unit being supported such that the first and fourth means and the second and third means are magnetically coupled and the host unit provides a power signal and a data signal applied to the first means, the power signal being rectified by the rectifier means to provide operative power for the second circuit means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
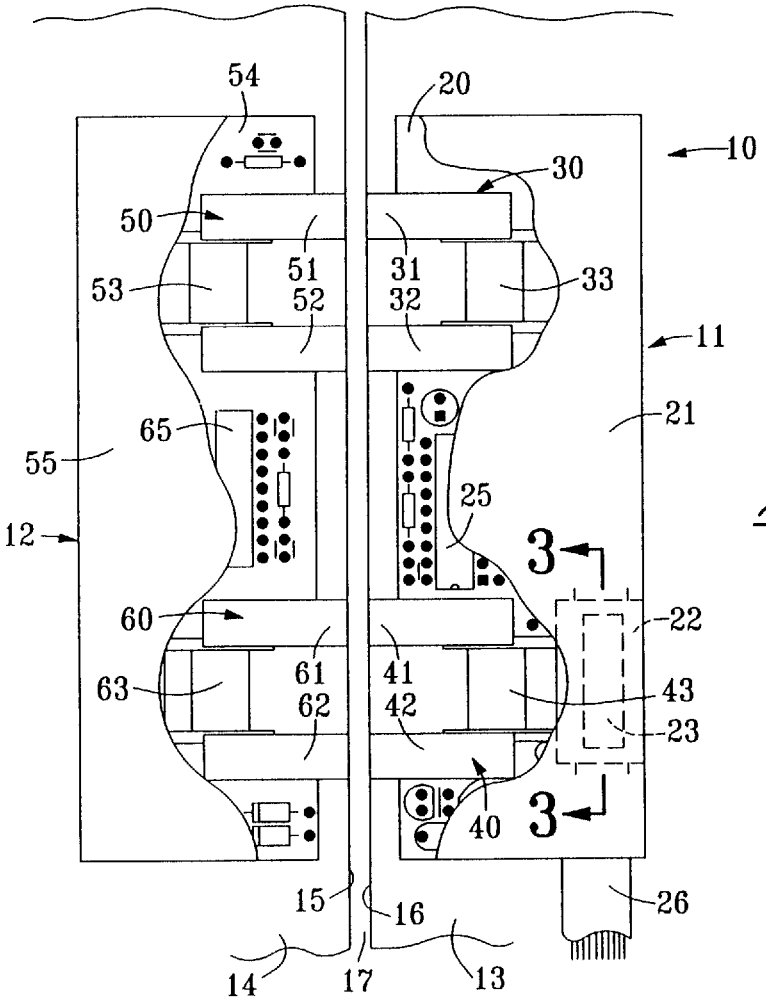
FIG. 1 sets forth a partially sectioned view of an intrusion detector constructed in accordance with the present invention secured to a fixed frame and movable door.

FIG. 1 sets forth a partially sectioned view of an intrusion detector constructed in accordance with the present invention and generally referenced by numeral 10. Intrusion detector 10 includes a host unit 11 and a transponder unit 12 positioned upon a door frame 13 and a movable door 14 in an inwardly facing relationship. Because host unit 11 is usually secured to the fixed or stationary portion of a door, window or other opening, host unit 11 is hereinafter sometimes referred to as the stationary unit. Conversely, because transponder unit 12 is usually secured to the movable portion of a door, window or other opening, transponder unit 12 is hereinafter sometimes referred to as a movable unit. In the example shown in FIG. 1, host unit 11 is secured to a door frame 13 while transponder unit 12 is secured to a movable door 14. It will be apparent to those skilled in the art that the use of a door and door frame in FIG. 1 is merely illustrative of a virtually endless combination of door, window or other opening environments in which the present invention is operative. Door frame 13 defines an interior edge 16 while door 14 defines an edge 15. Edges 15 and 16 are separated by a clearance gap 17 in accordance with conventional fabrication techniques. Thus, in the environment illustrated in FIG. 1, door frame 13 is stationary while door 14 is movable with respect thereto as door 14 is opened either by swinging or sliding away from door frame 13. Of importance with respect to the present invention is the separation of transponder unit 12 from its alignment with host unit 11 whenever door 14 is opened.

Figure 3:
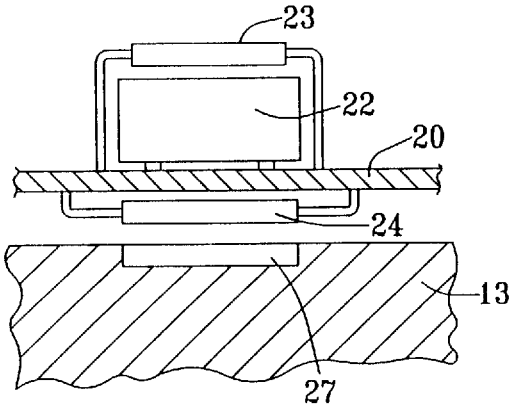
FIG. 3 sets forth a partial section view of the stationary portion of the present invention intrusion detector taken along section lines 3—3 in FIG. 1.

Host unit 11 includes a protective housing 21 which is secured to the surface of door frame 13. Housing 21 is fabricated of a high strength material to resist mechanical intrusion and tampering and supports an electronic circuit board 20 having a plurality of electronic circuit components comprising the electronic circuit set forth below in FIG. 4 in schematic detail. Of importance to note in FIG. 1 is the placement of a pair of U-shaped electromagnetic cores 30 and 40 preferably supported upon circuit board 20 within housing 21. For purposes of illustration, integrated circuit 25 is shown positioned upon circuit board 20 together with various other electronic components. Also supported upon circuit board 20 and shown in greater detail in FIG. 3 is a master relay 22 and a magnetically operated relay 23 also better seen in FIG. 3. The electronic circuitry of circuit board 20 is coupled to a control unit (seen in FIG. 4 by a plurality of connecting wires forming a multiconnection cable 26).

In accordance with the preferred operation of the present invention, U-shaped core 30 is positioned such that ends 31 and 32 thereof are generally aligned with edge 16 of door frame 13. An energizing coil 33 encircles the bridging portion of U-shaped core 30 in accordance with conventional fabrication techniques. Similarly, U-shaped core 40 is supported such that ends 41 and 42 thereof are generally aligned with edge 16 of door frame 13. An energizing coil 43 is wound upon the bridging portion of U-shaped core 40 in accordance with conventional fabrication techniques.

Upon transponder unit 12, a similar and generally "mirror image" arrangement is provided for U-shaped cores 50 and 60 upon circuit board 54 supported within housing 55 of transponder unit 12. Thus, U-shaped core 50 is supported upon circuit board 54 within housing 55 such that ends 51 and 52 thereof are generally aligned with edge 15 of door 14. Energizing coil 53 is wound upon the bridging portion of U-shaped core 50. Also, U-shaped core 60 is supported upon circuit board 54 within housing 55 such that ends 61 and 62 thereof are generally aligned with edge 15 of door 14. Energizing coil 63 is wound upon the bridging portion of U-shaped core 60.

The electronic circuit supported upon circuit board 54 of transponder unit 12 is set forth below in FIG. 5 in schematic detail. By way of illustration, integrated circuit 65 represents a typical electronic component supported upon circuit board 54 and operative in the manner described below.

In operation and assuming initially that movable door 14 is closed with respect to door frame 13 providing the alignment of host unit 11 and transponder unit 12 in the manner shown in FIG. 1, host unit 11 and transponder unit 12 interact on a repeated cyclic basis which continuously confirms the closed door condition for door 14. More specifically, with door 14 closed, the cycle of operation is initiated by host unit 11 which applies a short duration burst of square wave signal to coil 43. In the preferred embodiment of the invention, this burst of square wave signal is relatively short in the order of four hundred milliseconds. However, other duration bursts of signal may be utilized without departing from the spirit and scope of the present invention. The energizing of coil 43 produces a corresponding magnetic energy within U-shaped core 40. The alignment and relative position of U-shaped core 60 of transponder unit 12 results in magnetic energy coupling between core 40 and core 60. The magnetic energy thus imparted to U-shaped core 60 produces an induced voltage in core 63 of transponder unit 12. By means set forth below in greater detail, transponder unit 12 rectifies the voltage induced in coil 63 and stores the energy therefrom in a capacitor. This stored voltage provides operating supply for the electronic circuitry within transponder unit 12. Following the burst of square wave energy, host unit 11 further applies a data signal to coil 43 which is magnetically coupled from core 40 to core 60 and results in a corresponding voltage in coil 63. The data signal imparted in this manner from host unit 11 to transponder unit 12 comprises a random number generated within host unit 11 together with a unique identifying number code which corresponds to the unique identifying number of host unit 11.

Transponder unit 12 receives the data signal induced in coil 63 and decodes the random number and unique identifying number code. The identifying number thus received is compared to a stored representation of the identifying number of host unit 11 within transponder unit 12 to confirm the data signal origin as being host unit 11. If the identifying number code does not match, transponder unit 12 ignores the random number data. If the identification code received by transponder unit 12 matches the stored reference number, transponder unit 12 then utilizes the decoded random number data and applies a predetermined algorithm thereto to calculate a pseudo-random number which is then applied in the form of a data signal to coil 53. The application of the pseudo-random number signal to coil 53 produces a magnetically coupled signal between U-shaped core 50 and U-shaped core 30 of host unit 11. In response, a data signal voltage is induced in coil 33.

In a concurrent operation conducted during the time transponder unit 12 is performing the above-described steps, host unit 11 performs a calculation of a pseudo-random number using the same random number data imparted to transponder unit 12 and the same algorithm employed by transponder unit 12. The resulting calculated pseudo-random number is stored within host unit 11 and maintained until the transmitted pseudo-random number is received at coil 33. Thereafter, the pseudo-random number received from transponder unit 12 is compared to the stored pseudo-random number calculated by host unit 11. In the event a match is found, host unit 11 maintains the on condition of master relay 22 indicative of a closed door and the absence of tampering. In the event the pseudo-random numbers compared do not match, transponder unit 11 deactivates master relay 22 signaling an alarm or intrusion condition which is responded to by the system control unit (seen in FIG. 4).

The above-described cycle repeats continuously and so long as the magnetic coupling between host unit 11 and transponder unit 12 as well as the proper exchange of data and coded information continues, the condition of master relay 22 is maintained in the on condition and the system is quiescent. In the event, however, an intrusion is attempted either by moving door 14 with respect to frame 13 or attempting to substitute an external magnetic source of the type typically used to defeat such intrusion detectors, the above-described cycle is incomplete and host unit 11 responds by deactivating master relay 22 and triggering an alert condition.

It will be apparent to those skilled in the art that the cyclical operation by which the present invention system repeats the cycle of host unit energizing of transponder unit 12 together with the exchange of identifying code number and random number provides substantial protection for the present invention system against intrusion or tampering or other attempts to defeat the system. The calculation of a pseudo-random number independently within host unit 11 and transponder unit 12 based upon the use of an identical algorithm and the identical randomly generated number assures that host unit 11 will respond solely to the presence of transponder unit 12.

Figure 2:
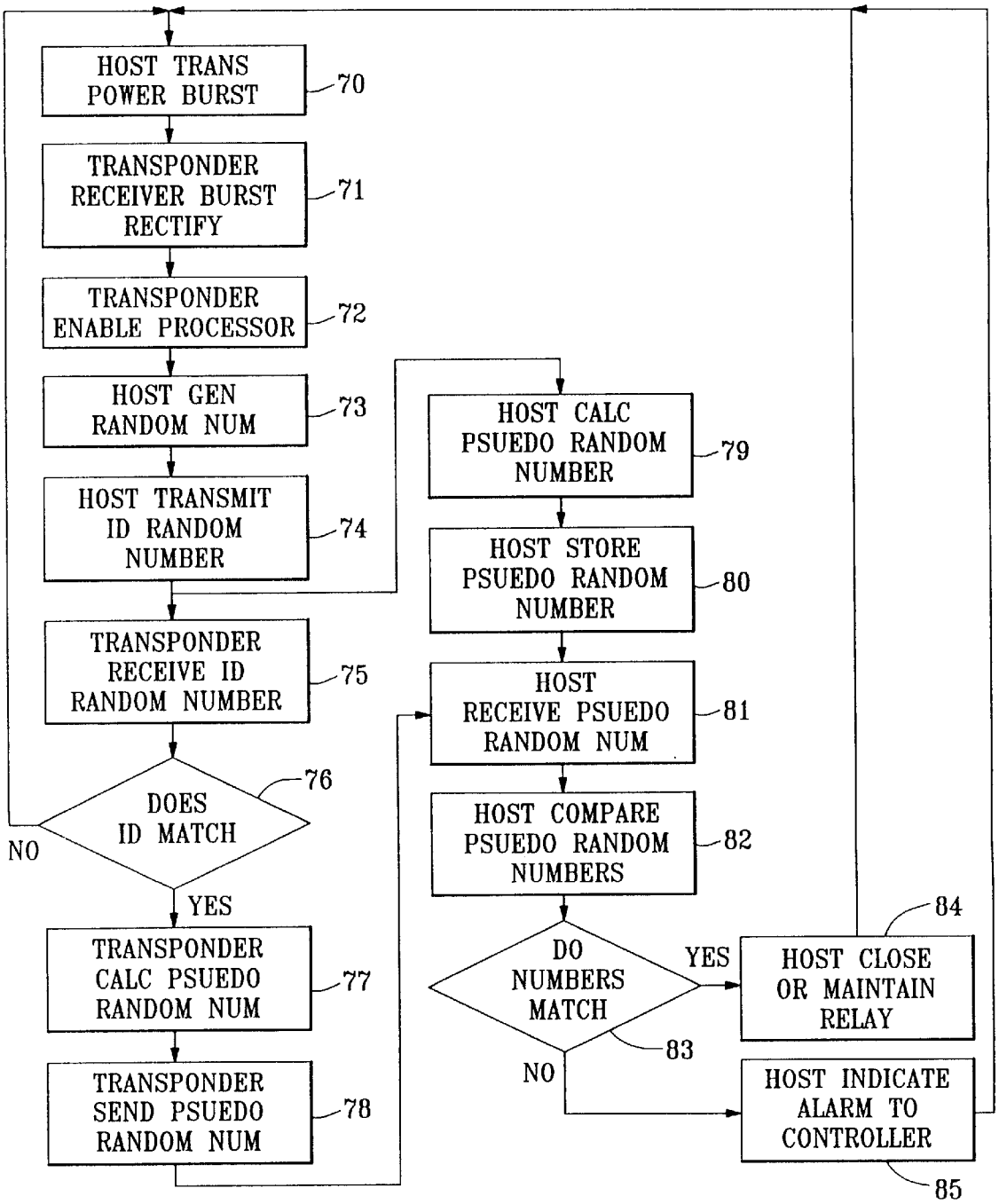
FIG. 2 sets forth a flow diagram illustrative of the operation of the present invention intrusion detector.

FIG. 2 sets forth a flow diagram of the operation of the present invention intrusion detector. It will be recalled from the above-descriptions that the present invention intrusion detector repeatedly cycles through an operation in which energy for operating supply voltage is transferred from the host unit to the transponder unit afterwhich data including a unique identifying number code of the host unit and a random number generated within the host are communicated through magnetic coupling of the host unit and transponder unit magnetic coupling interface. Thereafter, each unit performs the same algorithm calculation upon the random number to produce a pseudo-random number which is then communicated back to the host unit from the transponder unit for comparison to confirm the continued presence of the transponder unit in a proximate and aligned condition indicative of a closed door.

More specifically, the present invention system initiates a cycle at a step 70 at which the host unit transmits a short duration burst of signal which comprises a power burst to the transponder. At step 71, the transponder receives and rectifies the power signal burst to provide operating power and to enable the processor within the transponder. Thereafter, at step 72, the processor is enabled and the operation continues. At step 73, the host unit generates a random number and, at step 74, the host unit transmits the random number together with the unique identifying number of the host unit in a data signal to the transponder.

At this point, the operations of the transponder and the host unit perform parallel operations in which the transponder unit at step 75 receives the identifying number of the host unit and the random number. At step 76, the transponder compares the received identifying number to the stored identifying number within the transponder's processor memory at step 76. If a match is not found, the transponder unit ignores further communication and returns to initial step 70 awaiting the next power burst. If, however, a match is found, the system moves to step 77 in which the transponder calculates a pseudo-random number by applying a predetermined algorithm to the random number received from the host unit. At step 78, the transponder sends the pseudo-random number to the host unit via the coupling magnetic interface.

At step 79 following the host transmission of identification number and random number at step 74, the host unit calculates a pseudo-random number by applying the same algorithm as used by the transponder to the random number previously generated by the host unit. At step 80, the host unit stores the pseudo-random number. Thereafter, at step 81, the host unit retrieves the stored pseudo-random number calculated by the host unit and receives the pseudo-random unit sent by the transponder unit at step 78.

At step 82, the host unit compares the pseudo-random numbers. It will be recognized that since the same random number is used by both the host unit and transponder unit and the same algorithm is employed, the pseudo-random numbers calculated by the host unit and the transponder unit should be identical. Any other number will, of course, indicate a false signal and reveal an intrusion or tampering attempt. Accordingly, at step 83, the host unit either indicates an alarm condition to the controller at step 85 in the absence of a number match or, alternatively, closes or maintains closure of the master relay at step 84. In either event, steps 84 or 86 represent the completion of an operative cycle and the system returns to step 70 whereupon the next cycle of operation is initiated.

It will be recognized by those skilled in the art that the present invention system in the operation set forth in FIG. 2 provides significant barriers and difficulties to individuals attempting intrusion or defeat of the present invention intrusion detector. For example, the exchange of a random number between host unit and transponder unit is extremely difficult for intruders to replicate. Further, the simultaneous independent calculation by the host unit and transponder unit of a derivative pseudo-random number using a common unknown algorithm is even more difficult to replicate. Finally, the comparison of calculated pseudo-random numbers in the host unit closes the loop on the system operation and implements a very high level of confidence requirement to maintain closure of the system relay.

The present invention system further exhibits substantial advantage in that the transponder unit is entirely free of a power source of its own and is entirely dependent upon the continued presence of the host unit to maintain operative power for its circuitry. As a result, the freedom enjoyed by the security system operatives in placing the present invention intrusion detector is substantial. In essence, the intrusion detector may be placed without regard for any requirement to couple operative power through conductive connections or the like to the transponder unit. Thus, the need for wire connections and the difficulties associated therewith for the transponder unit upon the movable door, window or the like is completely eliminated.

In addition, the use of a unique identifying number for the host unit which is recognized by the transponder unit further assures that only data transmitted by the host unit will be received and operated upon by the transponder unit. In essence, this defeats attempts to place a surrogate host unit of any type in communication with the transponder unit in hopes of defeating the system.

In addition to the several levels of electronic security provided in the above-described operation of the present invention intrusion detector, attention is also given to the likelihood of physical intrusion attempts by would-be-intruders. In preventing such physical intrusion, security systems must often contend with magnetic implements utilized by would-be-intruders in proximity to the master system relay in hopes of overriding the entire system and maintaining closure of the master relay despite intrusion. The present invention system protects against such magnetic implement intrusion or defeat attempts utilizing the apparatus shown in FIG. 3.

FIG. 3 sets forth a partial section view of host unit 11 taken along section lines 3—3 in FIG. 1. By way of overview, it will be understood that the purpose of the system components shown in FIG. 3 is to provide protection against attempts to employ magnetic implements against master relay 22 and thereby override and defeat the present invention system. For example, one such method of attempting system override involves the positioning of a strong magnet sufficiently close to the system master relay to force closure of the relay despite the above-described system operation and the normal deactivation of the master relay in initiating an alarm signal condition. Another anticipated intrusion attempt involves the physical removal of the host unit from the attachment to door frame 13. This removal constitutes an initial step in attempting to either substitute a bogus host unit in place of host unit 11 and achieve intrusion or, alternatively, tamper with the circuitry of circuit board 20 of host unit 11 again attempting to override the system and falsely maintain closure of the master relay.

More specifically, FIG. 3 shows circuit board 20 of host unit 11 supporting master relay 22 in a conventional fabrication. In addition, a magnetic reed type relay 23 is interconnected in the circuitry of host unit 11 in the manner shown in FIG. 4 and is physically positioned above master relay 22. A similar magnetic reed relay 24 is physically positioned on the underside of circuit board and is electrically connected as is also shown in the schematic diagram of FIG. 4. Finally, a permanent magnet 27 is secured to door frame 13 in alignment with magnetic relay 24.

In operation, the presence of magnetic relay 23 above master relay 22 provides a responsive switch which senses strong magnetic fields imposed upon the area of master relay 22. Since magnetic relay 23 responds immediately to such magnetic fields, the closure of relay 23 provides the operational response shown in FIG. 4 by imposing an immediate alarm condition and indicating an alarm condition to the control unit. Thus, the would-be-intruder is frustrated as a magnet is brought into proximity to master relay 22 by the immediate response of magnetic reed relay 23.

In a similar operation, the close proximity of magnetic reed relay 24 to magnet 27 within door frame 13 maintains closure of relay 24. In the circuit configuration of host unit 11 shown in FIG. 4, it will be noted that relay 24 in series with master relay 22. As a result, the continued open of magnetic relay 24 is an essential precondition for the closure of master relay 22. Accordingly, in the event physical tampering is undertaken which removes host unit 11 from door frame 13, the magnetic coupling between magnet 27 and relay 24 is disturbed allowing relay 24 to revert to an closed condition which in turns opens the master relay triggering an alarm condition to the controller and moving the system immediately to an alarm condition.

In this manner, the integrity of master relay 22 against override and tampering is maintained together with the integrity of attachment of host unit 11 to door frame 13. It will be recognized by those skilled in the art that while the present invention system is believed to derive substantial advantage through the use of magnetic reed relays in the above-described protective apparatus, other magnetically responsive elements may be used without departing from the spirit and scope of the present invention.

Figure 4:
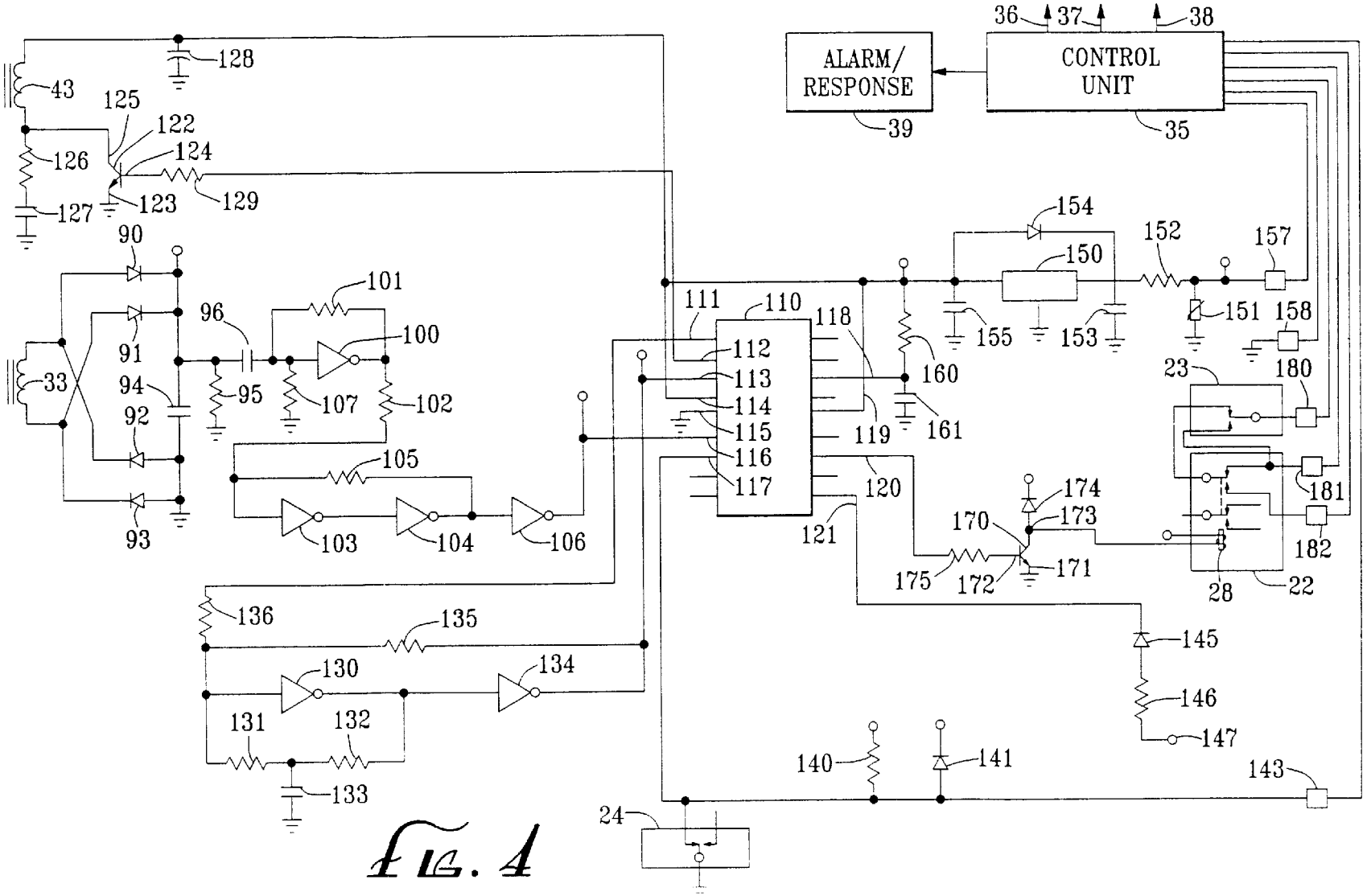
FIG. 4 sets forth a schematic drawing of the stationary or host unit of the present invention intrusion detector.

FIG. 4 sets forth a schematic diagram of host unit 11 together with an exemplary control unit and alarm response. The circuit of host unit 11 includes a coil 33 wound upon U-shaped core 30 (seen in FIG. 1) and a coil 43 wound upon a U-shaped core 40 (also seen in FIG. 1). Coil 33 is coupled to a full wave rectifier configuration formed of a diodes 90 through 93 together with a filter capacitor 94 and a resistor 95. The output of the full wave rectifying circuit thus formed is coupled to an inverter 100 by a capacitor 96. Inverter 100 operates in combination with a resistor 101 and a resistor 107 to provide a linear analog amplifier, the output of which is coupled to a resistor 102. Resistor 102 couples the output of inverter 100 to the input of an inverter 103 which in turn is coupled to an inverter 104. The output of inverter 104 is fed back to the input of inverter 103 by a resistor 105. The combination of inverters 103 and 104 together with resistor 105 form an analog to digital converter. The output of the analog to digital converter thus formed is coupled to an inverter 106 which in turn is coupled to data input terminal 116 of an integrated circuit 110.

Integrated circuit 110 is the microprocessor of the host unit and employs a conventional integrated circuit manufactured by Micro Chip Corporation and having a standard device number PIC16C54. Integrated circuit 110 includes a control voltage signal output 111, a data output terminal 112, an incrementing signal input 113, a reset terminal 114, a ground terminal 115, a data input terminal 116, and a test signal output 117. Integrated circuit 110 further includes a clock circuit output 118, an operating supply terminal 119 and a relay control signal output 120 together with a relay condition indicating signal output terminal 121.

An inverter 130 is coupled to control signal output 111 of integrated circuit 110 by a resistor 136. The output of inverter 130 is coupled to a pair of series resistors 132 and 131 together with a capacitor 133. The output of inverter 130 is coupled to an inverter 134 having an output which is coupled to incrementing signal input 113 of integrated circuit 110. A feedback resistor 135 is coupled between the output of inverter 134 and the input of inverter 130. The combination of inverters 130 and 134 together with resistors 131, 132 and 135 and capacitor 133 form a voltage controlled oscillator utilized in the above-described random number generation. The frequency of operation of the voltage controlled oscillator thus formed is controlled by the control signal output at terminal 111 of integrated circuit 110.

Coil 43 is coupled to a source of operating supply and to reset terminal 114 of integrated circuit 110. The remaining side of coil 43 is coupled to ground through the series combination of a resistor 126 and a capacitor 127. An NPN transistor 122 includes an emitter 123 coupled to ground, a base 124 coupled to data output terminal 112 of integrated circuit 110 by a resistor 129, and a collector 125 coupled to coil 43. A filter capacitor 128 is coupled between coil 43 and ground.

A conventional voltage regulator 150 having a standard device number 78L05 includes a regulated voltage output 156 coupled to ground by a filter capacitor 155. Voltage regulator 150 receives an operating supply voltage from control unit 35 through terminal 157 and a series resistor 152. A filter capacitor 153 is coupled between the voltage input to regulator 150 and ground. A varistor 151 is coupled between terminal 157 and ground to provide over voltage protection. A power supply protecting diode 154 is coupled across regulator 150.

The operating supply for integrated circuit 110 is coupled to terminal 119. A resistor 160 and capacitor 161 are coupled to clock circuit input 118 to provide a time constant for the internal clock of integrated circuit 110.

An NPN transistor 170 includes an emitter 171 coupled to ground, a base 172 coupled to output 120 of integrated circuit 110 by a resistor 175, and a collector 173. Collector 173 is coupled to operating supply through coil 28 of master relay 22. A protective diode 174 is coupled between collector 173 and a source of operating supply. A light emitting diode 145 is coupled to output terminal 121 of integrated circuit 110 and to a source of operating supply 147 by a resistor 146.

The operating circuit of the host unit of FIG. 4 is coupled to a control unit 35 by a plurality of connections 157, 158, 180, 181, 182 and 143. Control unit 35 is further coupled to an alarm/response unit 39. In addition, for purposes of illustration, control unit 35 is shown further coupled by cables 36, 37 and 38 to additional host units similar in fabrication to host unit 11 described above each of which should be understood to have similar circuitry to that shown in FIG. 4. Terminal 157 provides an operating supply input from control unit 35 to host unit 11 while terminal 158 provides a common ground connection therebetween. Connection 180 provides communication of the condition of magnetic reed relay 23 to control unit 35 while terminals 181 and 182 provide connection indicative of the opened and closed positions respectively of master relay 22. Finally, connection 143 communicates the operative condition of magnetic reed relay 24 and/or a test signal between control unit 35 and host unit 11.

In operation, processor 110 operates in accordance with a stored instruction set which implements the cyclical operation set forth and described in FIG. 2. Accordingly, the processor within integrated circuit 110 initially produces an output signal at terminal 112 which comprises the above-described square wave power burst. The power burst signal is applied to transistor 122 causing transistor 122 to repeatedly switch between conduction and nonconduction. The switching of transistor 122 produces a switching current within coil 43 producing the magnetic energy within U-shaped core 40 (seen in FIG. 1) which, as described above, provides a burst of operative power for the circuitry within transponder unit 12. Suffice it to note here that a time varying current is produced within coil 43 for a short time interval. Following the power burst signal, the processor within integrated circuit 110 produces a data signal at terminal 112 which is also applied to transistor 122 causing it to switch between conductive and nonconductive conditions and thereby energize coil 43 with the above-described data signal. It will be recalled that this data signal following the power burst includes a unique identification number for host unit 11 as well as a random number generated within the host unit.

Random number generation is carried forward in the host unit by the combination of the voltage controlled oscillator formed by inverters 130 and 134 and an internal eight-bit counter within integrated circuit 110 (not shown). In essence, the eight-bit counter within integrated circuit 110 is repeatedly incremented by the oscillator output signal applied to terminal 113 thereof. As the eight-bit counter is repeatedly cycle between its maximum and minimum counts, a succession of numbers is produced. The counter signal is randomly accessed to retrieve a random number which is utilized as the random number for communication to transponder unit 12 in the above-described manner.

It will be recalled from the above-described operation that following the transmission of a power burst and data signal having an identifying number and random number from the host unit to the transponder unit, the transponder unit performs a pseudo-random number calculation and transmits the calculated pseudo-random number back to the host unit. The transmission of the pseudo-random number is provided between coil 53 and core 50 of transponder unit 12 and core 30 and coil 33 of host unit 11 (seen in FIG. 1). Accordingly, coil 33 receives data signals from transponder unit 12 in the form an induced voltage within coil 33. This voltage is full wave rectified by diodes 90 through 93 to produce a single polarity data signal which is coupled to a linear amplifier including inverter 100 by a capacitor 96. This analog data signal thus amplified is converted to a digital signal by the combination of inverters 103 and 104 and resistor 105. Inverter 106 inverts the data signal and applies it to data signal input terminal 116 of integrated circuit 110. Thus, transmitted data from transponder unit 12 is received by coil 33, full wave rectified, amplified and converted to a digital signal input at terminal 116. Within integrated circuit 110, a comparator circuit is operative to compare the received pseudo-random number to an internally computed pseudo-random number in accordance with the above-described operation.

In the event the number comparison provides a match, an output signal indicative of signal match is outputted at terminal 120 which in turn turns on transistor 170 energizing coil 28 of master relay 22. In response to the energizing of coil 28, master relay 22 switches to an on condition in which connection 182 is connected to relay 23. Concurrently, the determination of pseudo-random number match within integrated circuit 110 also causes terminal 121 to be coupled to ground which in turn energizes light emitting diode 145 providing a visual indication of normal or closed condition of the security system.

As described above, relay 23 is normally open in the absence of an intrusive magnetic field and thus the closure of master relay 22 couples terminal 182 to terminal 180 providing an indication of secure condition and closure to control unit 35. In the event a number match is not obtained within integrated circuit 110, the output signal at terminal 120 turns transistor 170 off causing coil 28 to be deenergized and opening master relay 22. In this event, master relay 22 assumes its open condition connecting terminal 181 to relay 23. This condition is indicative of intrusion and is so interpreted by control unit 35. In response, control unit 35 activates alarm/response unit 39 which may comprise a variety of conventional warning apparatus such as blinking lights, audible alarms, or communication to an operator of an intrusion condition.

In the event relay 23 is closed due to the proximity of a strong magnetic field, relay 23 switches to its closed condition which in turn couples terminal 180 to terminal 181 which also indicates an intrusion or alarm condition to control unit 35. Once again, in response to such input condition, control unit 35 activates alarm/response unit 39.

It will be recalled that relay 24 (as seen in FIG. 3) is maintained in a normally open condition by the proximity of magnet 27 within door frame 13. In the closed condition, terminal 117 of integrated circuit 110 is maintained at ground and test signal input 23 is similarly grounded or maintained at a low voltage state. Conversely, in the event of tampering which removes relay 24 from its proximity to magnet 27, relay 24 switches to its closed circuit condition allowing terminal 117 and test signal terminal 143 to switch to a low signal condition which in turn triggers an alarm within control unit 35.

Figure 5:
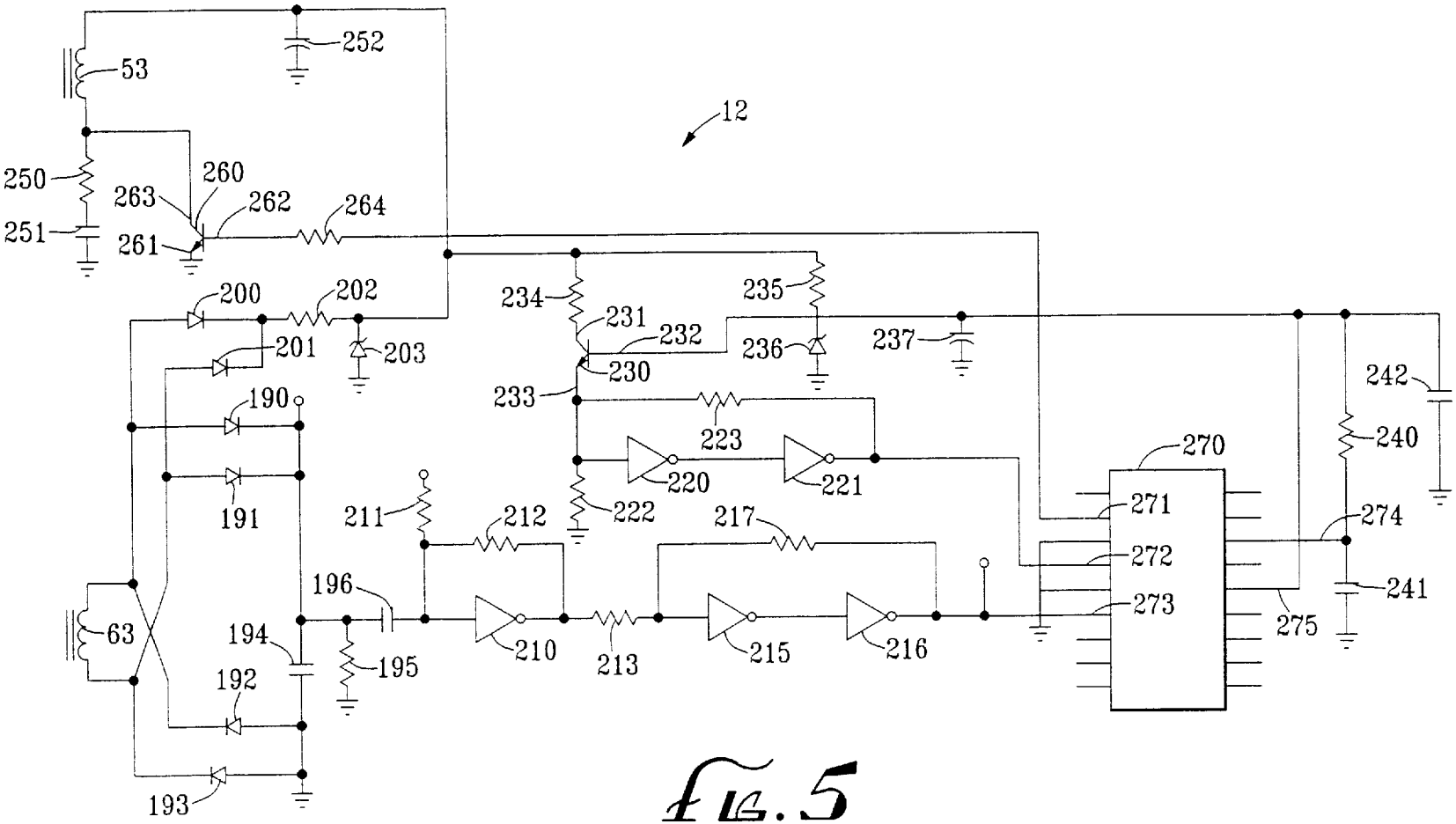
FIG. 5 sets forth a schematic drawing of the movable or transponder portion of the present invention intrusion detector.

FIG. 5 sets forth a schematic diagram of transponder unit 12. Thus, the circuit of transponder unit 12 includes a coil 63 which, as is set forth above in FIG. 1, is wound upon U-shaped core 60. Coil 63 is coupled to a full wave rectifier formed by a quartet of diodes 190, 191, 192 and 193 coupled to a capacitor 194 and resistor 195. The output signal of the full wave rectifier thus formed is coupled by a capacitor 196 to the input of an inverter 210. The output of inverter 210 is coupled to the input of an inverter 215 by a resistor 213. A feedback resistor 212 is coupled between the input and output of inverter 210. A resistor 211 couples the input of inverter 210 to operating supply. The output of inverter 215 is coupled to the input of an inverter 216, the output of which is coupled to data input 273 of integrated circuit 270. A feedback resistor 217 is coupled between the output of inverter 216 and input of inverter 215.

An integrated circuit 270 which in the present embodiment comprises a standard integrated circuit having device number PIC16C54 manufactured by Micro Chip Corporation provides the microprocessor unit of transponder 12. Integrated circuit 270 includes a data output terminal 271, reset terminal 272 and a data input terminal 273. Integrated circuit 270 further includes a clock signal terminal 274 and an operating supply terminal 275. Additional terminals within integrated circuit 270 are coupled to ground. A series combination of a resistor 240 and a capacitor 241 are coupled to terminal 274 to provide an R-C time constant for the internal clock circuit of integrated circuit 270. A filter capacitor 242 is coupled between operating supply terminal 275 and ground.

Coil 53, which as set forth above in FIG. 1, is wound upon U-shaped core 50 and is coupled to ground through the series combination of a resistor 250 and a capacitor 251. A pair of power supply diodes 200 and 201 are coupled to coil 63 and are commonly coupled to a resistor 202 and a zener diode 203. The combination of diodes 200 and 201 together with resistor 202 and zener diode 203 provides a regulated power supply for operation of the circuitry of transponder 12. Accordingly, coil 53 is coupled to the power supply provided at the junction of zener diode 203 and resistor 202. A filter capacitor 252 is coupled between the high side of coil 53 and ground.

An NPN transistor 260 includes an emitter 261 coupled to ground, a base 262 coupled to data output terminal 271 of integrated circuit 270 by a resistor 264, and a collector 263 coupled to the junction of coil 53 and resistor 250.

A resistor 235 and zener diode 236 together with a filter capacitor 237 are coupled to the voltage supply at the junction of resistor 202 and zener 203 to provide a suitable operating voltage for integrated circuit 270 which is applied to terminal 275 thereof. A PNP transistor 230 includes an emitter 231 coupled to operating supply by a resistor 234, a base 232 coupled to the junction of resistor 235 and zener 236, and a collector 233 coupled to ground by a resistor 222. An inverter 220 has an input coupled to collector 233 of transistor 230 and an output coupled to the input of an inverter 221. The output of inverter 221 is coupled to reset terminal 272 of integrated circuit 270. A feedback resistor 223 is coupled between the output of inverter 221 and the input of inverter 220.

In operation, coil 63 is energized by the above-described power burst signal provided by host unit 11 through the magnetic coupling between core 60 and core 40 (seen in FIG. 1). This power signal is rectified by diodes 200 and 201 and regulated by zener 203 and resistor 202. Capacitor 252 provides filtering of the regulated operating supply thus provide. The operating supply voltage thus transmitted to coil 63 and rectified is applied to a reset enabling circuit formed of transistor 230 and inverters 220 and 221. The reset circuit operates in response to the rectification of applied burst signal to produce a DC voltage which turns on transistor 230 and provides a reset signal coupled through inverters 220 and 221. In addition, the rectified voltage thus provided is further regulated by resistor 235 and zener 236 and further filtered by capacitor 237 to provide the operating supply voltage applied to terminal 275 for integrated circuit 270. As a result, the transmission of the power burst signal provides enablement of integrated circuit 270 and operating supply for the circuitry of transponder unit 12. As described above, host unit 11 (seen in FIG. 1) transmits a further data signal to transponder unit 12 via coil 63 in the form of data having an identification number and random number. The combination of diodes 190 through 193 together with capacitor 194 and resistor 195 forms a full wave rectifier circuit which converts the data signals to a single polarity data signal which is applied to a linear amplifier formed by inverter 210. The data signal is converted from an analog to digital signal by the combination of inverters 215 and 216 together with feedback resistor 217. The resulting digital data signal is applied to data input terminal 273 of integrated circuit 270.

In this manner, the data information signal produced by host unit 11 (seen in FIG. 1) is communicated to integrated circuit 270 of transponder unit 12. It will be recalled that the present invention system operates using a cycle in which a short duration power signal burst is followed by a data signal in a repeated pattern. Thus, as each cycle is repeated, the operating supply of transponder unit 12 is repeatedly recharged or replenished. In between power signal bursts, data signals are communicated to data input 273 of integrated circuit 270. Each time a power burst signal is received and rectified to provide a replenishing of operating supply following a discharge of the operating supply (i.e., after door opened), the reset enabling circuit formed of transistor 230 and inverters 220 and 221 operates to reset and continue the operation of integrated circuit 270.

In accordance with the above-described method of operation, integrated circuit 270 upon receiving the data signal at data input 273, performs a comparison and match of the identifying number of host unit 11 and a decoding of the random number within the data signal. Integrated circuit 270 thereafter performs the calculation of a pseudo-random number utilizing an internally stored algorithm which is identical to the algorithm utilized by the processor of the host unit. Thereafter, integrated circuit 270 outputs the pseudo-random number at terminal 271 in the form of a data signal which is applied to base 262 of transistor 260. Transistor 260 is switched between conducting and nonconducting conditions in response to the applied data signal causing a corresponding switched variation of the current within coil 53. This signal varying current in coil 53 is magnetically coupled to coil 33 of host unit 11 via core 30 (seen in FIG. 1). As is described above, host unit 11 then performs a comparison of the pseudo-random number received back from transponder unit 12 and the internally calculated pseudo-random number to verify the continued presence of transponder unit 12.

Thus, in accordance with an important aspect of the present invention, the circuit of transponder unit 12 shown in FIG. 5 is operative in response to the cyclically applied pattern of power burst signal and data signal provided by host unit 11 to derive operative power and compute a pseudo-random number and thereafter retransmit the pseudo-random number back to the host unit for verification. The circuit of FIG. 5 also provides verification of host unit identity by decoding the identifying number within the transmitted data and performing a comparison to an internally stored identifying number.

What has been shown is a novel intrusion detector for security systems in which several tiers or levels of security are provided in a unique derivative operation and simultaneous pseudo-random number calculation. The several levels of validation and confirmation provided by the present invention system ensure the continued presence and alignment of a transponder with a stationary host unit.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An intrusion detector comprising:

a host unit having first means for magnetically communicating signals, second means for receiving magnetically communicated signals and first circuit means; and a transponder unit having third means for magnetically communicating signals, a fourth means for receiving magnetically communicated signals, second circuit means, and rectifier means coupled to said fourth means, said host unit and said transponder unit being supported such that said first and fourth means and said second and third means are magnetically coupled, said first circuit means having means for transferring a random number to said transponder via said first and fourth means and means for converting said random number to a host-converted number, said second circuit means having means for receiving said random number via said first and fourth means, converting said random number to a transponder-converted number and transferring said transponder-converted number to said host unit via said third and second means, said host unit having means for comparing said transponder-converted number to said host-converted number to detect intrusion.

2. The intrusion detector set forth in claim 1 wherein said host unit includes means for periodically transferring a power burst to said transponder unit via said first and fourth means and wherein said rectifier means convert said power burst to a transponder unit supply voltage.

3. The intrusion detector set forth in claim 2 wherein said host unit transfers a host-identifying number to said transponder unit via said first and fourth means and wherein said transponder unit includes means for comparing said transferred host-identifying number to a stored identifying number and aborting conversion of said random number in the absence of a match.

4. The intrusion detector set forth in claim 3 wherein said power burst, said host-identifying number and said random number are transferred in a periodically repeated signal.

5. The intrusion detector set forth in claim 4 wherein said host unit and said transponder unit use a common algorithm for converting said random number to said host-converted number and said transponder-converted number, respectively.

6. The intrusion detector set forth in claim 5 wherein said host unit includes a master relay responsive to said means for comparing and wherein said host unit further includes a magnetically responsive element supported in proximity to said master relay for detecting the presence of magnetic intrusion devices.

7. The intrusion detector set forth in claim 6 wherein said host-converted number and said transponder-converted numbers are pseudo random.

8. The intrusion detector set forth in claim 1 wherein said host unit transfers a host-identifying number to said transponder unit via said first and fourth means and wherein said transponder unit includes means for comparing said transferred host-identifying number to a stored identifying number and aborting conversion of said random number in the absence of a match.

9. A method of detecting an attempted intrusion through an openable access having a stationary element and a moveable element, said method comprising the steps of:

providing a host unit and a transponder unit one supported on the stationary element and the other supported on the moveable element;

providing means for magnetically coupling signals between said host unit and said transponder unit;

communicating a number from said host unit to said transponder unit via said means for magnetically coupling;

converting said number to a host-converted number within said host unit using an algorithm;

converting said number to a transponder-converted number within said transponder unit using the same algorithm;

communicating said transponder-converted number to said host unit via said means for magnetically coupling;

comparing said transponder-converted number to said host-converted number; and indicating an intrusion attempt based upon said comparing step when said transponder-converted number and said host-converted number do not match.

10. The method set forth in claim 9 further including the steps of:

communicating a power burst signal from said host unit to said transponder unit; and rectifying said power burst signal within said transponder unit to derive an operative power supply voltage.

11. The method set forth in claim 10 further including the steps of:

communicating a host-identifier number from said host unit to said transponder unit;

maintaining a reference host-identifier number within said transponder unit;

comparing said host-identifier number to said reference host-identifier number within said transponder unit; and causing said transponder unit to abort said step of communicating said transponder-converted number to said host unit when said host-identifier number and said reference host-identifier number do not match.

12. The method set forth in claim 9 further including the steps of:

communicating a host-identifier number from said host unit to said transponder unit;

maintaining a reference host-identifier number within said transponder unit;

comparing said host-identifier number to said reference host-identifier number within said transponder unit; and causing said transponder unit to abort said step of communicating said transponder-converted number to said host unit when said host-identifier number and said reference host-identifier number do not match.

13. The method set forth in claim 9 wherein said step of communicating a number includes the step of providing a randomly selected number.

14. An intrusion detector for detecting an attempted intrusion through an openable access having a stationary element and a moveable element, said intrusion detector comprising:

a host unit and a transponder unit one supported on the stationary element and the other supported on the moveable element;

means for magnetically coupling signals between said host unit and said transponder unit;

means for communicating a number from said host unit to said transponder unit via said means for magnetically coupling;

means for converting said number to a host-converted number within said host unit using an algorithm;

means for converting said number to a transponder-converted number within said transponder unit using the same algorithm;

means for communicating said transponder-converted number to said host unit via said means for magnetically coupling;

means for comparing said transponder-converted number to said host-converted number; and means for indicating an intrusion attempt based upon said comparing step when said transponder-converted number and said host-converted number do not match.

15. The intrusion detector set forth in claim 14 further including:

means for communicating a power burst signal from said host unit to said transponder unit; and means for rectifying said power burst signal within said transponder unit to derive an operative power supply voltage.

16. The intrusion detector set forth in claim 14 further including:

means for communicating a host-identifier number from said host unit to said transponder unit;

means for maintaining a reference host-identifier number within said transponder unit;

means for comparing said host-identifier number to said reference host-identifier number within said transponder unit; and means for causing said transponder unit to abort said step of communicating said transponder-converted number to said host unit when said host-identifier number and said reference host-identifier number do not match.

17. An intrusion detector for use between a stationary element and a moveable element, said intrusion detector comprising:

a host unit and a transponder unit, one of which is supported by a stationary element while the other is supported upon a corresponding moveable element;

said host unit having means for magnetically communicating a signal, having a power burst, an identifier and a number to said transponder unit and means for converting said number to a host-converted number, said transponder unit having means for converting said power burst to operative power and means for confirming that said identifier corresponds to said host unit and for receiving and converting said number to a transponder-converted number and for communicating said transponder-converted number to said host unit, said host unit including means for comparing said transponder-converted number to said host-converted number and for signaling an intrusion in the absence of a match between said transponder-converted number and said host-converted number.

* * * * *